US009121182B2

(12) United States Patent
Atkinson

(10) Patent No.: US 9,121,182 B2
(45) Date of Patent: Sep. 1, 2015

(54) WEIGHT ROOM FLOORING SYSTEM

(71) Applicant: George Atkinson, Indianapolis, IN (US)

(72) Inventor: George Atkinson, Indianapolis, IN (US)

( * ) Notice: Subject to any disclaimer, the term of this patent is extended or adjusted under 35 U.S.C. 154(b) by 0 days.

(21) Appl. No.: 14/496,456

(22) Filed: Sep. 25, 2014

(65) Prior Publication Data

US 2015/0082730 A1 Mar. 26, 2015

Related U.S. Application Data

(60) Provisional application No. 61/882,374, filed on Sep. 25, 2013.

(51) Int. Cl.

| | |
|---|---|
| ***B44C 1/26*** | (2006.01) |
| ***E04F 15/02*** | (2006.01) |
| ***E04F 15/10*** | (2006.01) |
| *A63B 6/00* | (2006.01) |

(52) U.S. Cl.

CPC ..... *E04F 15/02177* (2013.01); *E04F 15/02038* (2013.01); *E04F 15/02172* (2013.01); *E04F 15/105* (2013.01); *E04F 15/107* (2013.01); *A63B 6/00* (2013.01); *E04F 2201/091* (2013.01); *E04F 2201/095* (2013.01); *E04F 2290/044* (2013.01); *Y10T 428/31917* (2015.04)

(58) Field of Classification Search

CPC ..... B32B 2471/00; B32B 2327/06; B32B 38/145; B32B 2260/023; B32B 2307/412; A63B 6/00; A63B 2071/0694; E04F 15/02177; E04F 15/107; E04F 15/105; E04F 15/02038; E04F 15/02172; E04F 2201/095; E04F 2290/044; E04F 2201/091

USPC ..... 52/588.1, 515, 589.1; 428/67; 482/23

See application file for complete search history.

(56) References Cited

U.S. PATENT DOCUMENTS

| | | | | |
|---|---|---|---|---|
| 5,682,724 | A | 11/1997 | Randjelovic | |
| 5,780,147 | A * | 7/1998 | Sugahara et al. | 428/332 |
| 5,876,825 | A * | 3/1999 | Daley | 428/67 |
| 5,992,106 | A | 11/1999 | Carling | |
| 6,007,892 | A * | 12/1999 | Harwood et al. | 428/95 |
| 6,689,239 | B1 | 2/2004 | Grubic | |
| 6,871,363 | B2 * | 3/2005 | Sabados | 4/506 |
| 7,033,666 | B2 | 4/2006 | Skaja | |
| 7,093,395 | B2 | 8/2006 | Hinault et al. | |
| 7,571,572 | B2 | 8/2009 | Moller, Jr. | |
| 7,748,177 | B2 | 7/2010 | Jenkins | |
| 8,082,704 | B2 | 12/2011 | Stroppiana | |
| 2002/0142888 | A1 * | 10/2002 | Marques | 482/23 |
| 2006/0073305 | A1 * | 4/2006 | Kole | 428/80 |
| 2008/0214361 | A1 * | 9/2008 | Oster | 482/23 |
| 2009/0031662 | A1 * | 2/2009 | Chen et al. | 52/515 |
| 2009/0061168 | A1 * | 3/2009 | Kim et al. | 428/195.1 |
| 2009/0145066 | A1 * | 6/2009 | Pervan et al. | 52/309.15 |
| 2009/0148666 | A1 * | 6/2009 | Yeh | 428/159 |
| 2009/0155612 | A1 * | 6/2009 | Pervan et al. | 428/498 |
| 2009/0220730 | A1 * | 9/2009 | Price | 428/106 |

(Continued)

*Primary Examiner* — Brian Glessner
*Assistant Examiner* — Joshua Ihezie
(74) *Attorney, Agent, or Firm* — Woodard, Emhardt, Moriarty, McNett & Henry LLP

(57) ABSTRACT

Disclosed is a weight lifting station floor with a center portion that includes a resilient floor material, a translucent floor material, and a display layer positioned between the resilient floor material and the translucent floor material such that the display layer is visible through the translucent floor material, where the resilient floor material, the translucent floor material and the display layer are integrated together as a unitary structure.

19 Claims, 5 Drawing Sheets

(56) References Cited

U.S. PATENT DOCUMENTS

| | | | | |
|---|---|---|---|---|
| 2010/0092731 | A1* | 4/2010 | Pervan et al. | 428/172 |
| 2010/0260963 | A1* | 10/2010 | Feng Shen | 428/71 |
| 2010/0300030 | A1* | 12/2010 | Pervan et al. | 52/588.1 |
| 2010/0319282 | A1* | 12/2010 | Ruland | 52/309.3 |
| 2011/0052877 | A1* | 3/2011 | Yeh | 428/159 |
| 2011/0056158 | A1 | 3/2011 | Moller, Jr. | |
| 2011/0268937 | A1* | 11/2011 | Schacht et al. | 428/205 |
| 2011/0283642 | A1* | 11/2011 | Meirlaen et al. | 52/309.1 |
| 2011/0296780 | A1* | 12/2011 | Windmoller | 52/309.1 |
| 2012/0276348 | A1* | 11/2012 | Clausi et al. | 428/196 |
| 2013/0004751 | A1* | 1/2013 | Huang et al. | 428/203 |
| 2013/0014891 | A1* | 1/2013 | Vandevoorde et al. | 156/277 |
| 2013/0017372 | A1* | 1/2013 | Mechling et al. | 428/192 |
| 2013/0067842 | A1* | 3/2013 | Meersseman et al. | 52/309.4 |
| 2013/0104485 | A1* | 5/2013 | Meersseman et al. | 52/578 |
| 2013/0180195 | A1 | 7/2013 | Moller, Jr. | |
| 2014/0057767 | A1* | 2/2014 | Henniger et al. | 482/142 |
| 2014/0178694 | A1* | 6/2014 | Reenberg et al. | 428/414 |
| 2014/0227484 | A1* | 8/2014 | Sung et al. | 428/147 |
| 2014/0377515 | A1* | 12/2014 | Kim | 428/203 |

* cited by examiner

WEIGHT ROOM FLOORING SYSTEM

CROSS-REFERENCE TO RELATED APPLICATIONS

This application claims the benefit of U.S. Provisional Application No. 61/882,374, filed Sep. 25, 2013, which is hereby incorporated by reference.

BACKGROUND

This disclosure is in the field of flooring systems for weight rooms.

Weight rooms may include "power clean" rack locations configured to lift a barbell with weights into the air. After being lifted, the barbell with weights may be dropped from an elevated height to the floor. Traditionally, power clean rack locations include a reinforced platform placed over the floor to help absorb the energy of the dropped barbell and weights and to protect the underlying floor. Power clean rack locations may also provide visual definition to the area to mark the area used for power cleans. There are also stand alone units that are not necessarily combined with a rack. For example, Olympic Lifting Platforms.

Traditional power clean platforms include a central wooden platform flanked on either side by reinforced drop zones on top of a floor. The central wooden platform provides footing for the user while the reinforced drop zones are arranged to receive the dropped weights and barbell. The platforms can be subject to heavy wear and damage during use due to significant weights being dropped onto the platform from several feet.

DESCRIPTION OF THE ILLUSTRATED EMBODIMENTS

Figure 1:
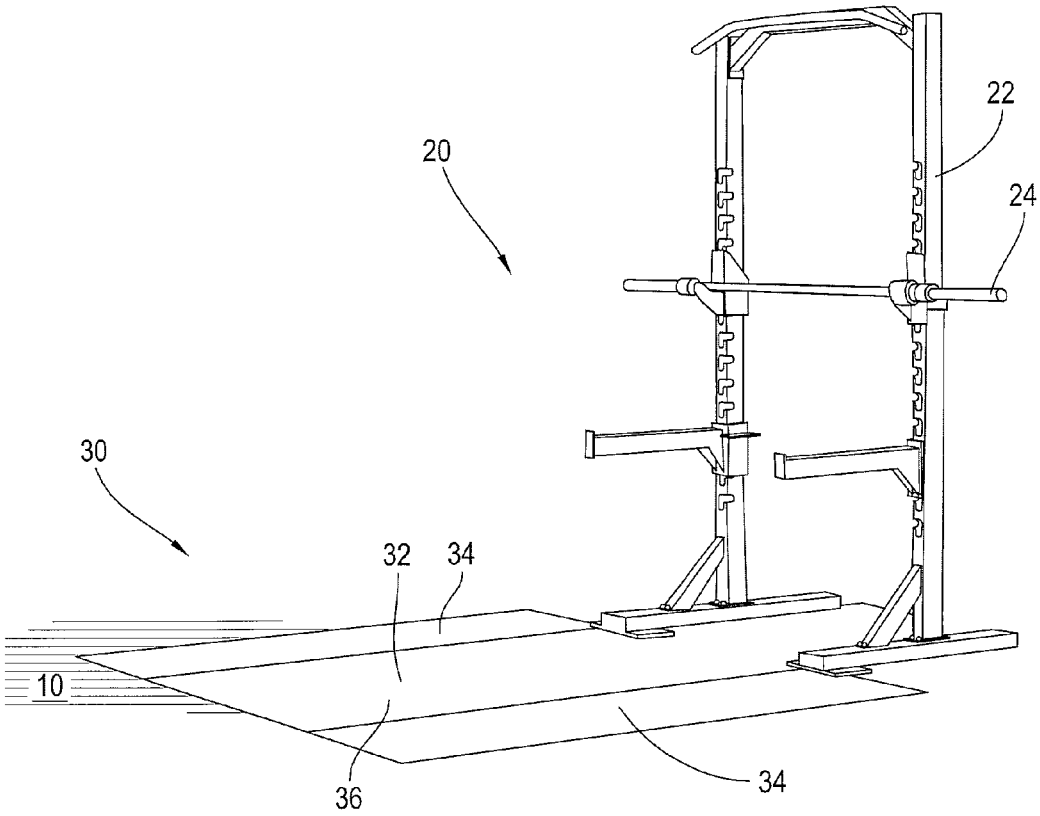
FIG. 1 is a perspective view of a weight lifting station including a weight lifting station floor with a center portion and two drop zones.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Disclosed is a flooring system for use with a weight lifting station.

Referring to FIG. 1, weight lifting station 20 and weight lifting station floor 30 are illustrated. Weight lifting station 20 includes rack 22 and barbell 24. Barbell 24 may hold a number of weights (not illustrated). Barbell 24 may be used for a variety of weightlifting exercises including, but not limited to, power cleans, clean and jerk, squats and shoulder presses.

Weight lifting station floor 30 includes center portion 32 and drop zones 34 on either side of center portion 32 Weight lifting station floor 30 is configured with the top surface flush with surrounding floor 10. Center portion 32 may optionally include design 36. Examples of design 36 include a colored pattern, an image, a logo, a wood grain or any combination of designs such as a logo surrounded by a wood grain design.

An individual lifting barbell 24 may on occasion drop the barbell from a height onto the floor. Drop zones 34 are constructed and arranged to absorb the energy of the dropped weights without permanent damage. Drop zones 34 may also include some degree of resiliency to protect the dropped weights from damage. For example, in one embodiment, weight lifting station floor 30 may be configured based on a weight of 800 pounds being dropped from a height of 9 feet. In another embodiment, weight lifting station floor 30 may be configured based on a weight of 400 pounds being dropped from a height of 9 feet.

Weight lifting station floor 30 may be configured as part of a larger flooring system where center portion 32 and drop zones 34 are adjacent to and coupled to surrounding flooring, for example, generic weight room flooring tiles, to form an integrated floor that includes weight lifting station floor 30. Center portion 32 and drop zones 34 may optionally include connective features (not illustrated), for example, dowel holes or integrated connecting system, as known in the art, to facilitate assembly with other flooring materials. In such an installation, center portion 32 and drop zones 34 may be the same height as other flooring components to create a flush top flooring surface without height discontinuities between different portions.

Figure 2:
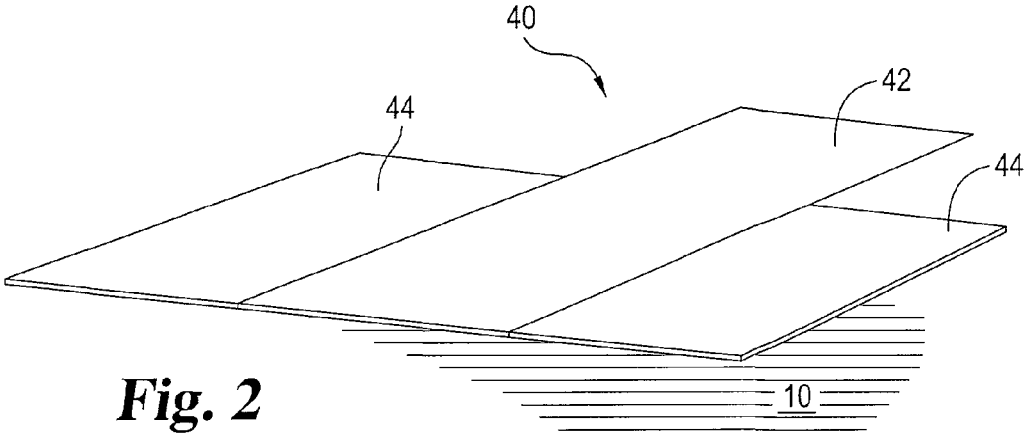
FIG. 2 is a perspective view of a raised platform weight lifting station floor including a center portion and two drop zones.

Referring now to FIG. 2, lifting platform 40 is illustrated. Lifting platform 40 includes platform center 42 and platform drop zones 44 on either side of center portion 42. In the illustrated embodiment, lifting platform 40 is positioned on top of surrounding floor 10 as a platform. In other embodiments, lifting platform 40 may be recessed in a pre-existing floor to minimize any height variation between lifting platform 40 and surround flooring. Drop zones 44 are constructed to absorb the energy of drop weights without permanently damaging drop zone 44. Drop zones 44 may also include some degree of resiliency to protect the dropped weights from damage. Lifting platform 40 may be positioned on top of surrounding floor 10. Lifting platform 40 may alternatively be installed in a cut out portion of flooring creating a flush or substantially flush flooring with lifting platform 40 integrated as part of the larger overall floor in a space.

Figure 3:
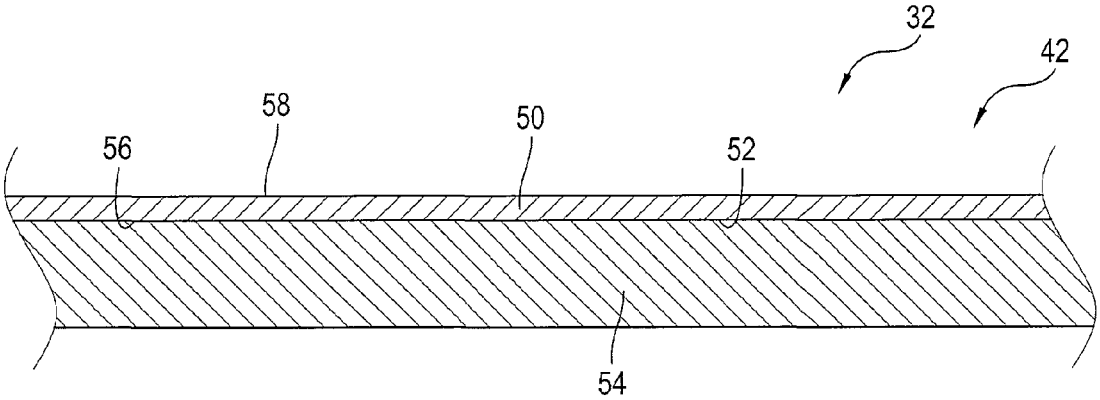
FIG. 3 is a side view of a center portion of a weight lifting station floor.

Referring now to FIG. 3, a side view of a center portion 32 or platform center 42 is illustrated. Center portion 32 includes translucent synthetic floor material 50, display layer 52 and resilient floor material 54. Translucent synthetic floor material 50, is display layer 52 and resilient floor material 54 preferably are adhered together to create an integrated unit. In some embodiments, translucent synthetic floor material 50 may be characterized as transparent. Center portion 32 typically has a minimum total thickness of approximately ⅜". In one embodiment, center portion 32 has a total thickness of approximately 1¼". In another embodiment, center portion 32 has a total thickness of approximately 1½". Platform center 42 includes the same construction as center portion 32. Platform center 42 also typically has a minimum total thickness of approximately ⅜". In one embodiment, platform center 42 has a total thickness of approximately 1¼". In another embodiment, platform center 42 has a total thickness of approximately 1½".

Translucent synthetic floor material 50 includes bottom surface 56 and top surface 58. Bottom surface 56 may be substantially smooth. Top surface 58 may include a non-smooth texture constructed and arranged as a non-slip finish. Top surface 58 may alternatively include a substantially smooth surface. In one embodiment, translucent synthetic floor material 50 is a sheet of clear polyvinyl chloride (PVC). Typically, translucent synthetic floor material 50 has a minimum thickness of 1/16". In one embodiment, translucent synthetic floor material 50 has a thickness of approximately ⅛". For a standard sized weight lifting station, translucent synthetic floor material 50 preferably is a unitary and continuous sheet that has no seams or discontinuities. This may reduce trip hazards and improve the footing for an individual using weight lifting station 20. This may also improve the visual appearance of flooring and reduce visual distortion of design 36. In one embodiment, translucent synthetic floor material 50 has a width of approximately 42 inches and a length of approximately 60 inches.

As used herein, translucent mean that the translucent synthetic floor material permits the passage of light, allowing display layer 52 to be viewed through the translucent synthetic floor material. Translucent floor material is intended to encompass both transparent materials that permit clear viewing of display layer 52 through the translucent synthetic floor material and materials that diffuse the transmission of light such that display layer 52 may not be clearly seen through the translucent synthetic floor material.

Translucent synthetic floor material 50 should also include some degree of impact-resistance to avoid fracturing if weights are accidently dropped on it. Sheet PVC with a ⅛" thickness (on top of a thicker resilient material) has been found to perform under the described conditions.

Display layer 52 may include printing on bottom surface 56 that is oriented toward translucent synthetic floor material 50 and is visible through translucent synthetic floor material 50. Printing may be applied to bottom surface 56 with a wide format printer. Alternatively, display layer 52 may include a printed sheet oriented so that the printing is visible through translucent synthetic floor material 50. Such a printed sheet may be translucent. In either case, display layer 52 may include a colored pattern, an image, a logo and/or a design. A wood grain design that simulates the appearance of a wooden platform may be used with a logo.

Resilient floor material 54 may comprise a synthetic rubber such as styrene-butadiene rubber (SBR) to provide the toughness, resiliency and thickness needed for this application. Alternatively, other resilient materials such as PVC may be used as resilient floor material 54. In yet other embodiments, natural resilient materials such as wood may be used as resilient floor material for center portions 32 or platform centers 42. Typically, resilient floor material 54 has a minimum thickness of approximately ¼". In one embodiment, resilient floor material 54 has a thickness of approximately 1⅛". In another embodiment, resilient floor material 54 has a thickness of approximately 1⅜".

Figure 4:
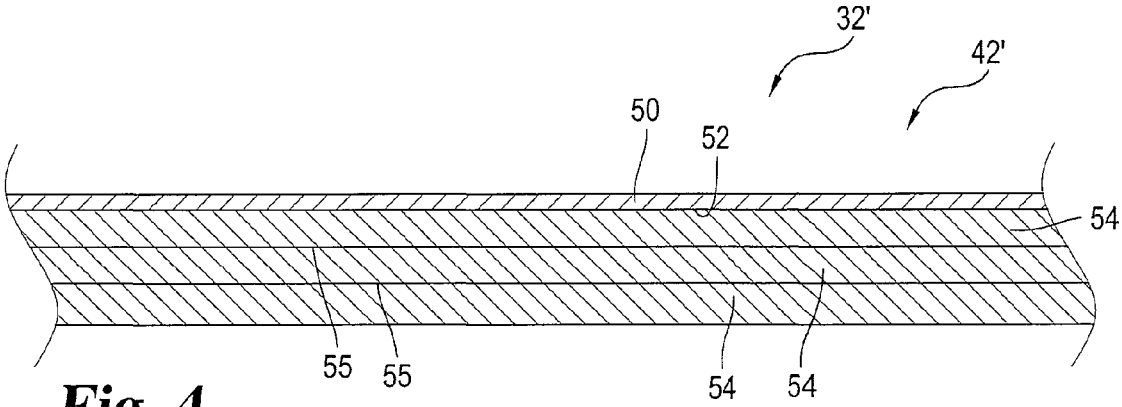
FIG. 4 is a side view of an alternative embodiment of the center portion of a weight lifting station floor.

Referring now to FIG. 4, a side view of an alternative embodiment of the center portion 32 or platform center 42 is illustrated as center portion 32' and platform center 42'. The description of center portion 32' below also applies to platform center 42'. Center portion 32' includes three layers of resilient floor material 54 adhered together with adhesive layers 55. SBR is available in sheets of various thicknesses. By layering multiple layers of resilient floor material 54 together, as illustrated, various total thicknesses can be obtained using standard product thicknesses.

Figure 5:
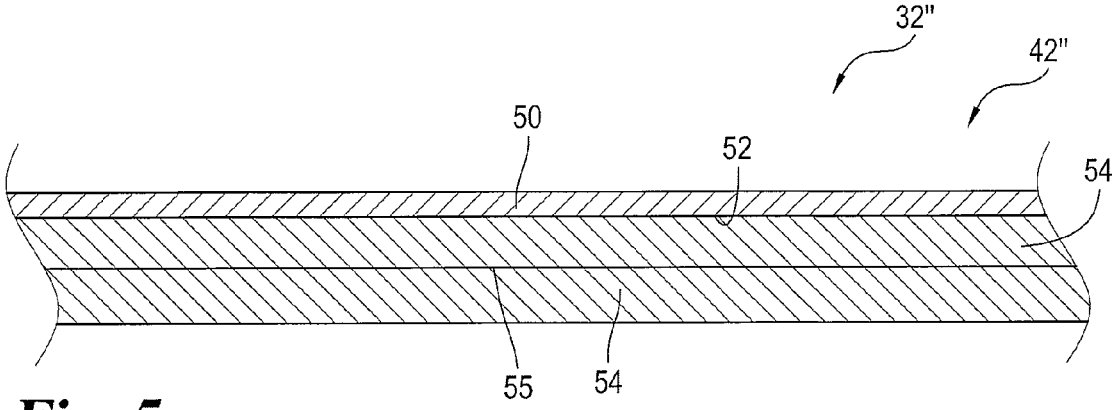
FIG. 5 is a side view of another alternative embodiment of the center portion of a weight lifting station floor.

Referring now to FIG. 5, a side view of another alternative embodiment of the center portion 32 or platform center 42 is illustrated as center portion 32" and platform center 42". Center portion 32" and platform center 42" include two layers of resilient floor material 54 adhered together with adhesive layer 55.

Figure 6:
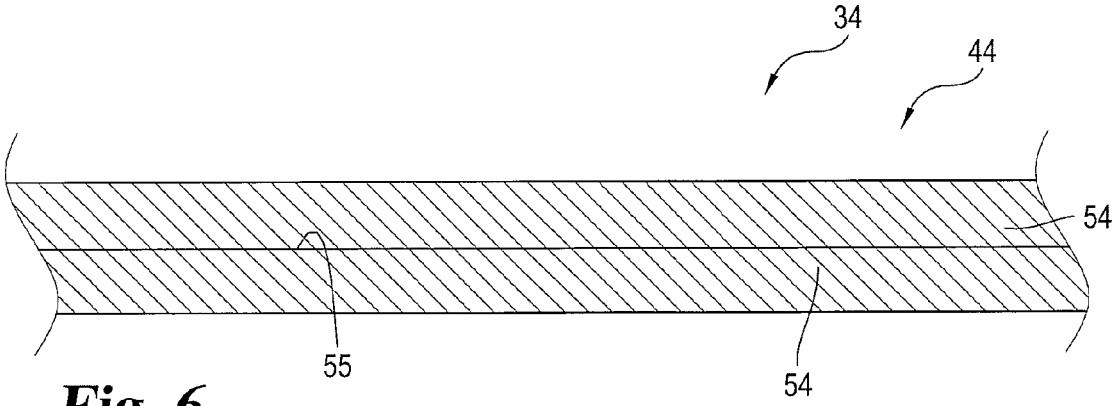
FIG. 6 is a side view of a drop zone.

Referring now to FIG. 6, a side view of drop zone 34 or drop zone 44 is illustrated. In the illustrated embodiment, drop zone 34 and drop zone 44 include two layers of resilient floor material 54 adhered together with adhesive layer 55. Other embodiments may utilize any number of layers of resilient floor material 54 desired, including, but not limited to one layer, three layers or four or more layers.

Figure 7:
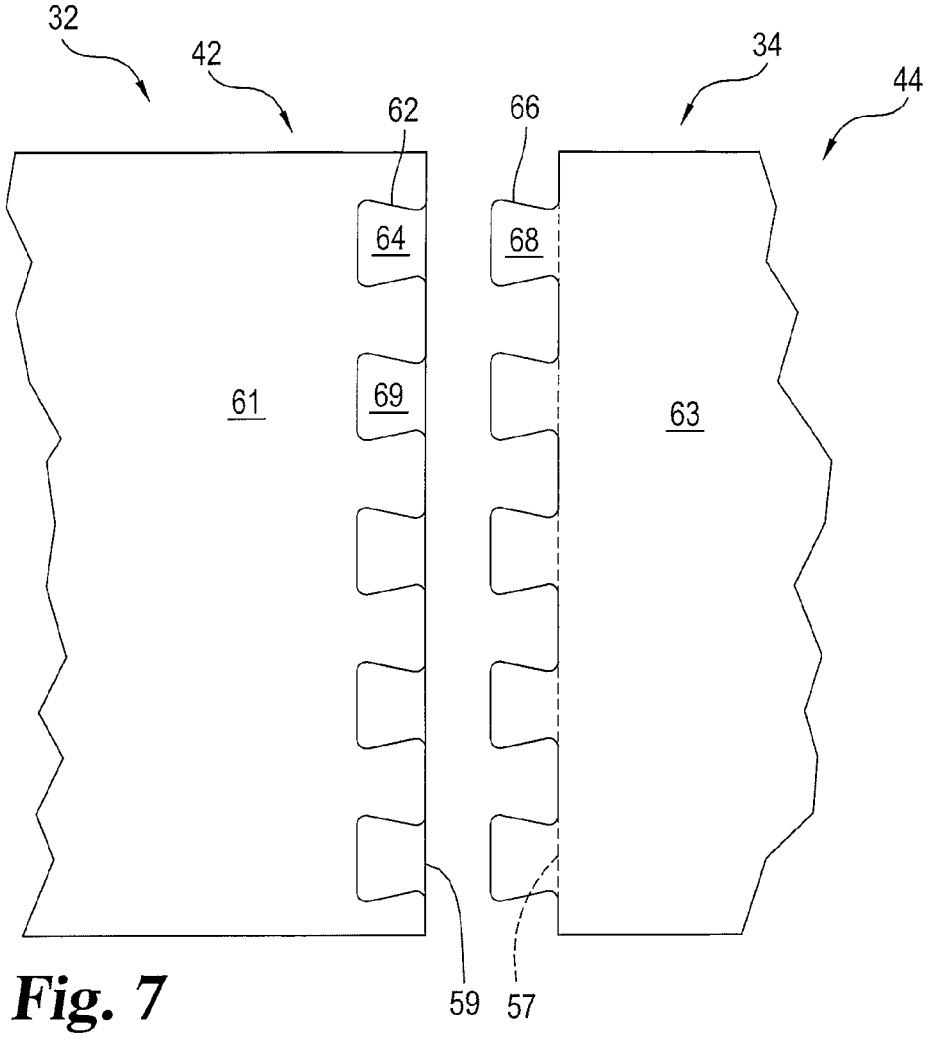
FIG. 7 is a bottom plan view of an embodiment of a center portion and a drop zone showing an interlocking geometry arrangement.
Figure 8:
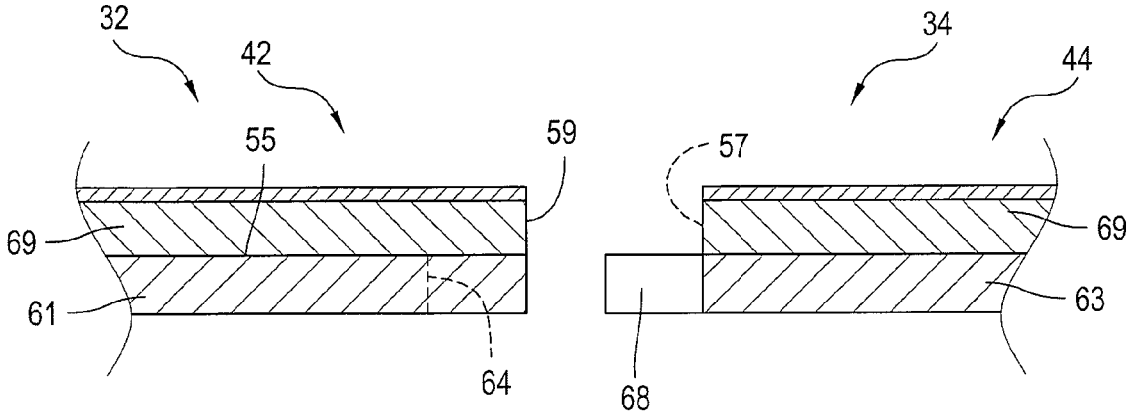
FIG. 8 is a side elevation view of the center portion and the drop zone shown in FIG. 7.

Referring now to FIGS. 7 and 8, a bottom plan view and a side elevation view of an embodiment of center portion 32 or platform center 42 and drop zones 34 or 44 are illustrated. In the illustrated embodiment, center portion 32 or platform center 42 includes resilient floor portion 69 and resilient floor portion 61. Resilient floor portion 69 includes straight edge 59. Resilient floor portion 61 includes profiled edge 62 that defines a plurality of recesses 64.

In the illustrated embodiment, drop zones 34 or 44 include one upper portion of resilient floor 69 and one lower portion of resilient floor material 63. Resilient floor portion 69 includes straight edge 57. Resilient floor lower portion 63 includes profiled edge 66 that defines a plurality of tabs 68. Tabs 68 are constructed and arranged to interlock in recesses 64 defining an interlocking geometry. Straight edge 59 is constructed and arranged to abut straight edge 57 to form a flush top surface with a straight seam when drop zones 34 or 44 are attached center portion 32 or platform center 42 by tabs 68 interlocking in recesses 64.

Profiled edge 62 defines a first interlocking geometry complementary with and constructed and arranged to interlock with a second interlocking geometry defined by profiled edge 66. Straight edges 57 and 59 are constructed and arranged to define a substantially straight transition on the top of weight lifting station floor 30 or lifting platform 40 between drop zones 34 or 44 and center portion 32 or platform center 42.

Profiled edges 62 and 66 may be created by cutting a commercially available sheet of resilient material with a cutting die or a water jet to form the desired shape. Alternatively, resilient floor portion 61 and 63 may be formed by molding a synthetic rubber such as SBR directly into the desired shape. Resilient floor portion 61 and 63 may comprise the same material used as resilient floor portion 69 or may comprise a different material. Resilient floor portions 61 and 63 may be integrally molded with resilient floor portions 69 or resilient floor portions 61 and 63 may comprise separate layers of resilient material as resilient floor portions 69.

Other embodiments can use different structures to connect drop zones 34 or 44 to center portion 32 or platform center 42. For example, dowel holes or integrated connecting system, as known in the art, can be incorporated into drop zones 34 or 44 and center portion 32 or platform center 42. In addition, weight lifting station floor 30 or lifting platform 40 may be adhered directly to a underlying floor material to maintain the relative position of all the components.

Figure 9:
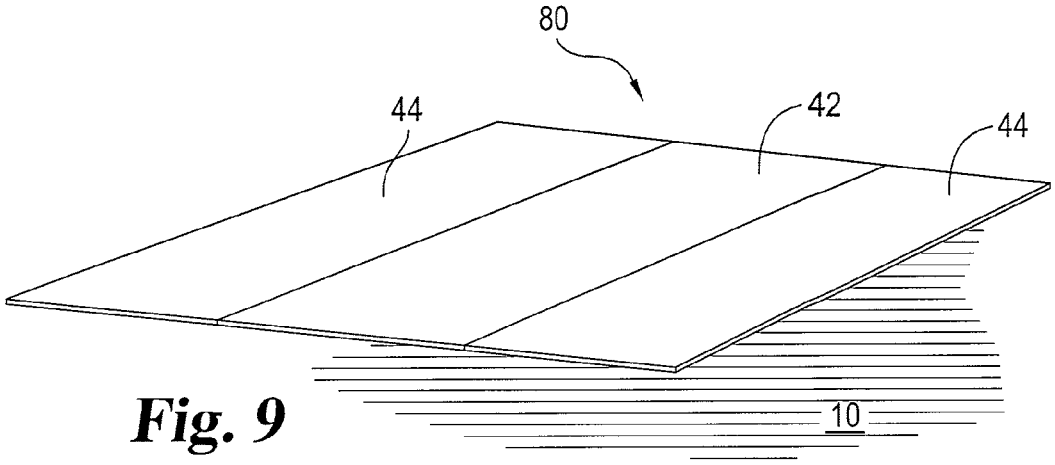
FIG. 9 is a perspective view of an alternative embodiment of a raised platform weight lifting station floor including a center portion and two drop zones.

Referring now to FIG. 9, lifting platform 80 is illustrated. Lifting platform 80 includes platform center 42 and platform drop zones 44 on either side of center portion 42, with drop zones 44 extending the length of platform center 42. In the illustrated embodiment, lifting platform 80 is positioned on top of surrounding floor 10 as a platform. In other embodiments, lifting platform 80 may be recessed in a pre-existing floor to minimize any height variation between lifting platform 80 and surround flooring. Lifting platform 80 may alternatively be installed in a cut out portion of flooring creating a flush or substantially flush flooring with lifting platform 80 integrated as part of the larger overall floor in a space. Platform center 42 and platform drop zones 44 otherwise may include the same features describe above with regard to other embodiments.

Weight lifting station floor 30 or lifting platform 40 may be provided as a kit for retrofitting preexisting spaces or weight lifting station floor 30 or lifting platform 40 may be integrated as part of a new floor installation that includes additional flooring. The overall thickness of weight lifting station floor 30 or lifting platform 40 may be selected to match existing flooring.

Note that while adhesives are discussed above as useful for joining layers of flooring together, other fastening methods can also be used with the disclosed flooring, including, but not limited to external mechanical fasteners and integrated mechanical interlocking features. In one embodiment, a pressure sensitive adhesive is used to join layers of flooring together.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

I claim:

1. A weight lifting station floor mat comprising:

a center portion comprising;

a resilient floor material comprising styrene-butadiene rubber;

a translucent floor material;

a display layer positioned between said resilient floor material and said translucent floor material such that said display layer is visible through said translucent floor material, wherein said resilient floor material, said translucent floor material and said display layer are integrated together as a unitary structure; and first and second drop zones positioned on opposite sides of said center portion, wherein said first and second drop zone each comprise styrene-butadiene rubber and wherein said translucent floor material does not cover either the first or second drop zones.

2. The weight lifting station floor of claim 1, wherein said translucent floor material is clear flexible vinyl.

3. The weight lifting station floor of claim 1, wherein said translucent floor material comprises a textured side constructed and arranged as a non-slip finish, wherein said textured side is faced away from said resilient floor material.

4. The weight lifting station floor of claim 1, wherein said translucent floor material comprises a smooth side that is faced toward said resilient floor material.

5. The weight lifting station floor of claim 4, wherein said display layer comprises printing on said smooth side of said translucent floor material.

6. The weight lifting station floor of claim 4, wherein said display layer comprises a printed sheet oriented with the printing faced toward said translucent floor material.

7. The weight lifting station floor of claim 1, wherein said resilient floor material has a minimum thickness of approximately one quarter of an inch (6.4 mm).

8. The weight lifting station floor of claim 1, wherein said translucent floor material has a minimum thickness of approximately one sixteenth of an inch (1.6 mm).

9. The weight lifting station floor of claim 1, wherein said translucent floor material comprises a unitary and continuous sheet with no seams or discontinuities across its entire width and length.

10. The weight lifting station floor of claim 9, wherein said translucent floor material has a minimum width of approximately 42 inches (107 cm) and a minimum length of approximately 60 inches (152 cm).

11. The weight lifting station floor of claim 1, wherein said first and second drop zones have a height approximately equal to the stack height of said center portion.

12. The weight lifting station floor of claim 1, wherein said first and second drop zones are attached to said center portion.

13. The weight lifting station floor of claim 12, wherein said center portion comprises a first interlocking geometry constructed and arranged to interlock with a complementary second interlocking geometry on said first and second drop zones.

14. The weight lifting station floor of claim 13, comprising a straight transition on the top of said center portion and said first and second drop zones such that the top surface of the joints between said platform and said first and second drop zones is substantially straight.

15. The weight lifting station floor of claim 14, wherein said resilient floor material comprises a first and second layer, wherein said first and second drop zones comprises a third and fourth layer, wherein said first and third layers include said first and second interlocking geometries, wherein said second and fourth layers define a substantially straight first and second edge and wherein said substantially straight first and second edges abut when said first and second drop zones are positioned on opposite sides of said center portion.

16. The weight lifting station floor of claim 1, further comprising an adhesive between said resilient floor material and said translucent floor material.

17. The weight lifting station floor of claim 1, wherein said resilient floor material is approximately one and three eighth inches (34.9 mm) thick.

18. The weight lifting station floor of claim 1, wherein said translucent floor material is transparent.

19. A weight lifting station floor mat comprising:

a center portion that is at least 42 inches wide and 60 inches long, the center portion comprising;

a resilient floor material selected from the group comprising: synthetic rubber and styrene-butadiene rubber;

a unitary and continuous translucent flexible vinyl sheet having no seams or discontinuities and sized to cover the entire resilient floor material;

a display layer printed on said translucent flexible vinyl sheet and positioned between said resilient floor material and said translucent flexible vinyl sheet such that said display layer is visible through said translucent flexible vinyl sheet, wherein said resilient floor material, said translucent flexible vinyl sheet and said display layer are integrated together as a unitary structure; and first and second drop zones each comprising a resilient material, wherein said first and second drop zones are positioned on opposite sides of said center portion, wherein said translucent flexible vinyl sheet does not cover the first and second drop zones.

* * * * *